US009514614B2

(12) United States Patent
Valentino, III et al.

(10) Patent No.: US 9,514,614 B2
(45) Date of Patent: Dec. 6, 2016

(54) REAL TIME PLAYING CARD VALUATION

(71) Applicants: Henry Valentino, III, Las Vegas, NV (US); Robert Conde, Las Vegas, NV (US); Travis Whidden, Las Vegas, NV (US); Jeremiah Morrill, Las Vegas, NV (US)

(72) Inventors: Henry Valentino, III, Las Vegas, NV (US); Robert Conde, Las Vegas, NV (US); Travis Whidden, Las Vegas, NV (US); Jeremiah Morrill, Las Vegas, NV (US)

(73) Assignee: eConnect, Inc., Las Vegas, NV (US)

( * ) Notice: Subject to any disclaimer, the term of this patent is extended or adjusted under 35 U.S.C. 154(b) by 0 days.

(21) Appl. No.: 13/775,248

(22) Filed: Feb. 24, 2013

(65) Prior Publication Data

US 2014/0243061 A1 Aug. 28, 2014

(51) Int. Cl.

| | |
|---|---|
| ***A63F 1/00*** | (2006.01) |
| ***G07F 17/32*** | (2006.01) |
| *A63F 1/12* | (2006.01) |

(52) U.S. Cl.

CPC ..... *G07F 17/3293* (2013.01); *G07F 17/322* (2013.01); *A63F 1/00* (2013.01); *A63F 1/12* (2013.01); *A63F 2001/003* (2013.01)

(58) Field of Classification Search

CPC ..... G07F 17/3293; A63F 1/00; A63F 1/12; A63F 3/00157; A63F 2001/003

USPC ..... 463/11–13; 273/293, 303, 149 P

See application file for complete search history.

(56) References Cited

U.S. PATENT DOCUMENTS

| | | | | |
|---|---|---|---|---|
| 5,451,054 | A * | 9/1995 | Orenstein | A63F 1/18 273/148 R |
| 6,126,166 | A * | 10/2000 | Lorson | A63F 1/14 273/148 A |
| 2003/0195025 | A1* | 10/2003 | Hill | 463/11 |
| 2005/0062226 | A1* | 3/2005 | Schubert | A63F 1/14 273/149 R |
| 2010/0216532 | A1* | 8/2010 | Halverson | A63F 3/00157 463/11 |
| 2011/0198804 | A1 | 8/2011 | Hessing et al. | |
| 2011/0269519 | A1 | 11/2011 | Shuster et al. | |
| 2012/0238337 | A1 | 9/2012 | French | |

* cited by examiner

*Primary Examiner* — Damon Pierce

(57) ABSTRACT

Technologies and implementations for determining advantages in a card game via a video capture device are generally disclosed.

18 Claims, 6 Drawing Sheets

REAL TIME PLAYING CARD VALUATION

BACKGROUND

Unless otherwise indicated herein, the approaches described in this section are not prior art to the claims in this application and are not admitted to be prior art by inclusion in this section.

People enjoy playing various card games. Many card games may involve chance due to the seemingly randomness of shuffling of the playing cards. However, various strategies have been developed to determine advantages between players. Some players may try to utilize some of these strategies to their advantage when playing card games involving gambling such as, but not limited to, casino type card games.

SUMMARY

Described herein are various illustrative methods for real time playing card valuation. Example methods may include receiving image data of a first player receiving a first playing card from a playing card dispenser, determining a first value associated with the first playing card, the first value being based at least in part on markings on the first playing card, receiving image data of a second player receiving a second playing card from the playing card dispenser, determining a second value associated with the second playing card, the second value being based at least in part on markings on the second playing card, and determining an advantage between the first player and the second player based at least in part on the first value and the second value.

The present disclosure also describes various example machine readable non-transitory medium having stored therein instructions that, when executed by one or more processors, operatively enable a card valuation manager to receive image data of a first player receiving a first playing card from a playing card dispenser, determine a first value associated with the first playing card, the first value being based at least in part on markings on the first playing card, receive image data of second player receiving a second playing card from the playing card dispenser, determine a second value associated with the second playing card, the second value being based at least in part on markings on the second playing card, and determine an advantage between the first player and the second player based at least in part on the first value and the second value.

The present disclosure additionally describes example systems. Example systems may include a video capture device, a processor, and a card valuation module communicatively coupled to the processor and to the video capture device, the card valuation module configured to receive image data of a first player receiving a first playing card from a playing card dispenser, determine a first value associated with the first playing card, the first value being based at least in part on markings on the first playing card, receive image data of second player receiving a second playing card from the playing card dispenser, determine a second value associated with the second playing card, the second value being based at least in part on markings on the second playing card, and determine an advantage between the first player and the second player based at least in part on the first value and the second value.

The foregoing summary is illustrative only and not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure, and are therefore, not to be considered limiting of its scope. The disclosure will be described with additional specificity and detail through use of the accompanying drawings.

In the drawings.

DETAILED DESCRIPTION

Figure 1:
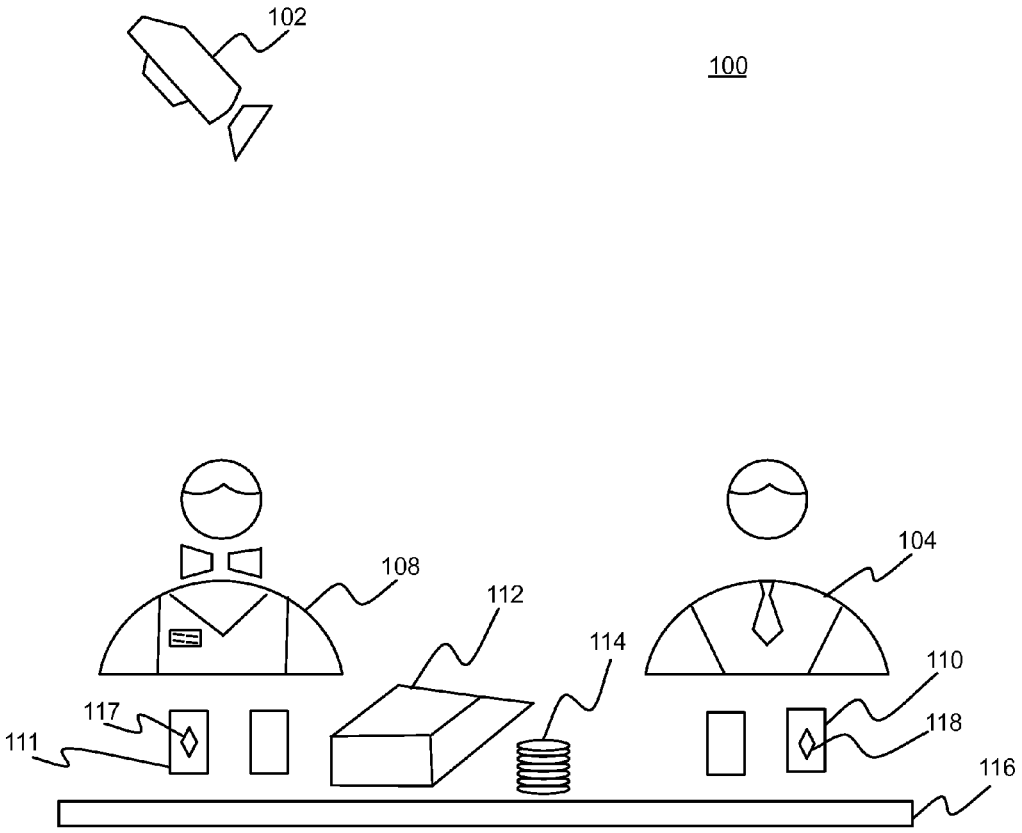
FIG. 1 illustrates a system for real time determination of advantages in a card game via a video capture device, in accordance with various embodiments.

The following description sets forth various examples along with specific details to provide a thorough understanding of claimed subject matter. It will be understood by those skilled in the art that claimed subject matter might be practiced without some or more of the specific details disclosed herein. Further, in some circumstances, well-known methods, procedures, systems, components and/or circuits have not been described in detail, in order to avoid unnecessarily obscuring claimed subject matter.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

This disclosure is drawn, inter alia, to methods, devices, systems and computer readable media related to real time determination of advantages in a card game via a video capture device.

Some people may try to utilize various strategies to determine an advantage during a card game. For a non-limiting example, in a casino type card game, such as but not limited to, blackjack, a player may try to utilize a strategy known as card counting. Card counting commonly involves keeping track of the relationship between high-value cards and low-value cards (i.e., the probability of whether the next hand will have a high-value card or a low-value card). Continuing with the example of the card game of blackjack, because of some inherent rules a dealer is required to follow, knowing the probability of whether the next hand will have a high-value card or a low-value card may help the player bet accordingly. For example, card counting may help determine if there is a higher probability that there may be more high-value cards than low-value cards remaining in the deck. Accordingly, the player who may be card counting may raise their bet because high-value cards may provide an advantage to the player, while low-value cards may provide an advantage to the dealer. As a result, the card counting player may be able to determine advantages in a card game.

Various embodiments described herein may be provided for the real time determination of an advantage in a card game via a video capture device. Additionally, various embodiments described herein may help facilitate determination of the composition of remaining cards during a card game. For example, in some embodiments, image data from one or more video cameras may be processed to determine the advantage in the card game in real time. In the example of the casino type card game of blackjack, a video camera may be used to monitor a blackjack table. During game play, the video camera may provide a video feed of the playing cards being played on the blackjack table. As the playing cards are removed from a deck of playing cards, the video feed may include image data regarding the type of card each player receives during the game (i.e., the type of cards already used). As each playing card is shown, the image data may be processed to determine an advantage in the card game (e.g., markings on the playing card to determine an advantage to the player or to the dealer). Alternatively, as each playing card is removed from the deck, the playing card may be recognized. For example, a deck of playing cards may be provided in an intelligent playing card dispenser, where the intelligent playing card dispenser may include technology for determining markings on the playing card either contained in the playing card dispenser or as the playing card leaves the playing card dispenser. The information regarding the determined markings on the playing card may be electronically provided for processing.

Continuing with the example of the card game of blackjack, in some examples, processing may include determining a value for each of the playing cards removed from the deck as the game is being played. The value may provide a running count of the cards being played. Additionally, processing may include a true count, where the true count may be based at least in part on the running count and the number of cards remaining in the deck. The number of cards remaining in the deck may be information available to the establishment, casino, or entity receiving the image data.

Continuing with the non-limiting example of blackjack, a surveillance camera may be capturing video of a blackjack game in progress. Image data from the video camera may be received for processing as the game is in progress. As the image data is processed, each playing card may be assigned a value. The value may be based at least in part on a card counting strategy. Each time a card is processed and a value determined, a running count may be determined. Additionally, a true count may be determined based at least in part on the running count and the number of cards remaining (e.g., number of deck of cards in a card dispenser such as, but not limited to, a card dealing shoe). In some embodiments, as the count (running and/or true count) reaches a particular threshold, the casino may be alerted to who may have an advantage (e.g., the player or the dealer), and the casino may take the appropriate steps.

In some embodiments, a player's betting habits may be processed to correlate with the determined advantages. For example, referring back to the blackjack example, the count may be such that the remaining cards in the shoe may advantage the player (e.g., more high-value cards than low-value cards). If the player's betting habits seem to match the determined advantage, there may be a chance that the player is trying to use some form of strategy, which may not necessarily be permitted in certain establishments.

It should be appreciated that the above-described non-limiting examples may be facilitated by image data from an image capturing device, and the image data being processed by one or more processors in real time. Accordingly, it is to be appreciated that these examples, as well as other examples provided herein are given for illustrative purposes only and are not intended to be limiting. For example, even though references may be made to casino type card games such as, but not limited to, blackjack, the present disclosure may be applicable to a wide variety of card games such as poker, baccarat, bridge, etc. Additionally, as will be appreciated the present disclosure may be applicable to a wide variety of image data processing methods, such as, but not limited to, bank note recognition, facial recognition, etc. Accordingly, the claimed subject matter is not limited in these respects.

FIG. 1 illustrates a system for real time determination of advantages in a card game via a video capture device, in accordance with various embodiments. In FIG. 1, the system 100 may include a video capture device 102. The video capture device 102 (hereon out camera) may be directed to capture images of a card game between a first player 104 (hereon out, player) and a second player 108 (hereon out, dealer). The dealer 108 may be dealing playing cards 110 and 111 from a playing card dispenser 112 (hereon out, shoe). Additionally, shown in the system 100 may be betting chips 114. For illustration purposes, a table 116 may be used as a surface to play the card game.

In the system 100, the camera 102 may facilitate reception of image data of the player 104 receiving a first playing card 110 from the shoe 112. A value associated with the first playing card 110 may be determined based at least in part on markings 118 on the playing card 110. Subsequently, the camera 102 may facilitate reception of image data of the dealer 108 receiving a second playing card 111 from the shoe 112. A second value associated with the second playing card 111 may be determined based at least in part on markings 117 on the second playing card 111. As a result, an advantage between the player 104 and the dealer 108 may be determined based at least in part on the first value and the second value, in accordance with various embodiments of the present disclosure.

The camera 102 may be a wide variety of cameras such as, but not limited to, bullet type closed circuit television cameras, dome type cameras, covert/desktop/board cameras, discreet cameras (e.g., within the table 116), infrared/night vision cameras, varifocal cameras, network/IP cameras, etc. or any combination thereof. Additionally, the camera 102 is not limited with respect to analog or digital images because analog signals may be converted for the purposes of receipt of an image data for processing. Accordingly, the camera 102 is not limited in these respects.

In FIG. 1, for the purposes of describing the disclosed subject matter, two players 104 and 108 may be shown.

However, it should be appreciated that a card game may have any number of players, and correspondingly, any number of cards.

In FIG. 1, the shoe 112 may be a wide variety of playing card dispensers such as, but not limited to, a common card dealing shoe (e.g., capable of holding one or more desks of playing cards), intelligent card dealing shoes (e.g., having various electronics to help facilitate card dealing and/or shuffling), etc., and accordingly, the claimed subject matter is not limited in these respects. For example, an intelligent card dealing shoe may be utilized to facilitate real time determination of advantages in a card game via a video capture device, in accordance with various embodiments of the present disclosure.

In order to facilitate ease of understanding the present disclosure, references to the non-limiting example of a casino type card game of blackjack may be made. However, it should be appreciated that the card game may include a wide variety of card games, such as, but not limited to, poker, baccarat, bridge, etc. or any card games, where determining the probability of what type of cards remain in the deck may be of some advantage from seemingly random shuffling. It follows that the markings 118 and 117 may be wide variety of markings on playing cards including images, numbers, characters, etc., and accordingly, the claimed subject matter is not limited in these respects.

Figure 2:
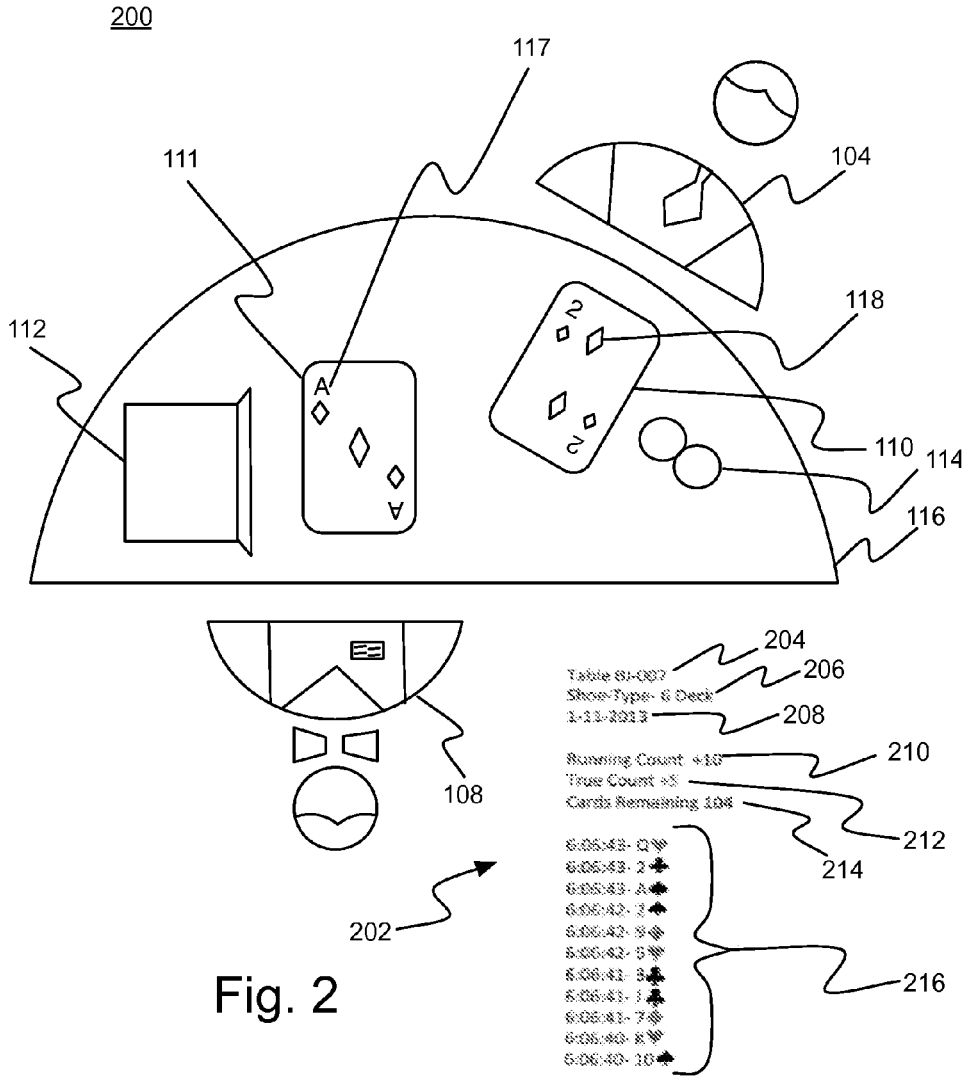
FIG. 2 illustrates a view of a playing card game as may be viewed by a video capture device, in accordance with various embodiments of the present disclosure.

FIG. 2 illustrates a view of a playing card game as may be viewed by a video capture device in accordance with various embodiments of the present disclosure. In FIG. 2, camera 102 (shown in FIG. 1) may be capturing images as shown in the view 200, and the view 200 may be displayed on a display device (not shown) configured for viewing by a viewer (not shown). The viewer may be any type of person who may monitor various card games such as, but not limited to an establishment personnel, a casino personnel, security personnel, information technology personnel, service provider personnel, etc., and accordingly, the claimed subject matter is not limited in these respects. Additionally, display device may be a wide variety of display devices such as, but not limited to, display monitor, tablet device, handheld device, mobile phone type device, smartphone type device, etc., and accordingly, the claimed subject matter is not limited in these respects.

As shown in FIG. 2, the view 200 may include a table 202 including various information regarding the real-time playing of the card game (e.g., blackjack). The table 202 may include information regarding table identification 204, shoe type information 206 (e.g., number of decks that may be held), date information 208, running count information 210, true count information 212, remaining card information 214, and card information 216 including time of drawing of the card.

In FIG. 2, running count information 210 may be determined based at least in part on the value of the cards 110 and 111, in accordance with one embodiment. Additionally, true count information may be determined based at least in part the running count and the number of playing cards remaining in the shoe 112. As will be described below, it should be appreciated that for some strategies, the running count information 210 may be slightly more accurate than the true count information 212 (e.g., 16 v. ten), and accordingly, both running count information 210 and true count information 212 may be determined and displayed in view 200.

As the viewer watches the card game in real-time, the viewer may be provided information to help facilitate various decision making, in accordance with various embodiments. For example, the view 200 may provide information to the viewer that the remaining cards in the shoe 112 may provide a slight advantage to the player 104, and as a result, the viewer may request an adjustment action (e.g., adding another deck and/or reshuffling the remaining cards in the shoe 112) in order to alter the advantage. In another example, the view 200 may provide information to the viewer that the player 104 may be using some form of strategy (e.g., card counting) to bet when advantage is with the player 104, and accordingly, the betting habit of the player 104 may be determined. The betting habit of the player 104 may be correlated to the determined advantage between the player 104 and the dealer 108, and if the correlated betting habit of the player 104 meets a particular threshold (e.g., seems to bet when the advantage is with the player 104, the viewer again may request an adjustment action of some kind (e.g., closely monitor the player 104, and/or remove the player 104 from the game after closely monitoring if necessary). In addition to the described embodiment, the betting habits of the player 104 may include technology based methods such as, but not limited to, RFID technology included in the betting chip 114 to facilitate information regarding the chip (e.g., amount, location, use, etc.).

Figure 3:
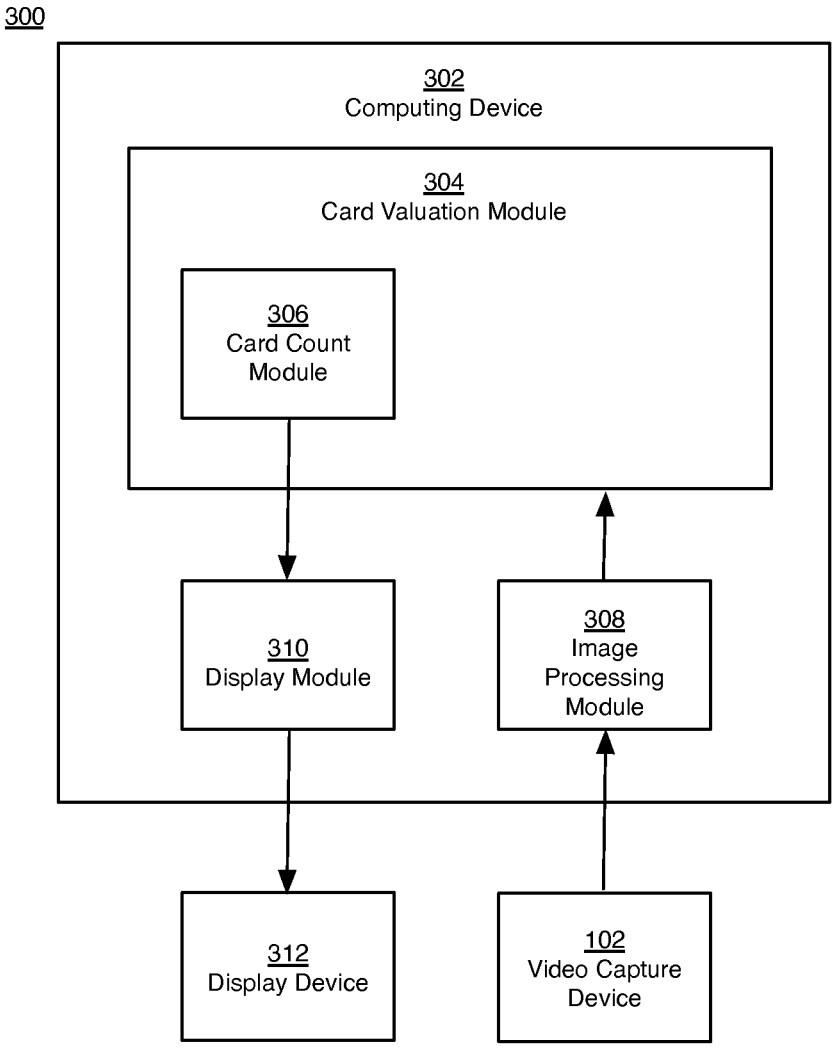
FIG. 3 illustrates a block diagram of an example card valuation environment, arranged in accordance with at least some embodiments described herein.

FIG. 3 illustrates a block diagram of an example card valuation environment 300, arranged in accordance with at least some embodiments described herein. The card valuation environment 300 may be implemented to determine advantages in a card game via a video capture device in real-time. In some examples, the card valuation environment 300 may be implemented to determine information to help facilitate adjustment actions during a card game, when a player may be advantaged too often including betting advantages.

As depicted, the card valuation environment 300 may include a computing device 302. The computing device 302 may be any type of computing device upon with image data may be processed such as, a laptop, a desktop, a server, a tablet computer, a smart phone, or the like.

In FIG. 3, the computing device 302 may include a card valuation module 304, in accordance with various embodiments of the present disclosure. The card valuation module 304 may include a card count module 306. The card valuation module 304 may be communicatively coupled to an image processing module 308 included in the computing device 302, and the image processing module may be communicatively coupled to the video capture device 102 (shown in FIG. 1). Additionally, the card valuation module may be communicatively coupled to a marking indicator 314. Computing device 302 may include a display module 310, and the display module 310 may be communicatively coupled to a display device 312.

In FIG. 3, computing device 302 may receive image data from the video capture device 102. The image data may be received at the image processing module 308, where the image processing module 308 may process the received image data (e.g., analog to digital as necessary). The card valuation module 304 may then receive the processed image data, where the value of the playing card may be determined. The value of the playing card may be based at least in part on markings 116 and 117 on the playing card 110 and 111. As previously described, information regarding the markings 116 and 117 may be received via the video capture device 102 (e.g., optical recognition) and/or from the shoe 112 (e.g., intelligent shoe). Accordingly, the value may be determined by applying a variety of methods (e.g., strategies). For example, the card valuation module 304 may be configured to employ one or more of the card counting strategies such as, but not limited to, Canfield Expert, Canfield Master, Hi-Lo, Hi-Opt I, Hi-Opt II, KISS 2, KISS 3, KO, Mentor, Omega II, Red Seven, REKO, Revere Adv. Plus-Minus, Revere Point Count, Revere RAPC, Revere 14 Count, Silver Fox, Unbalanced Zen 2, Uston Adv. Plus-Minus, Uston APC, Uston SS, Wong Halves, and Zen count. It should be appreciated that each of these strategies may include information such as, but not limited to, betting correlation (BC), playing efficiency (PE), insurance correlation (IC), Ease, and Type.

Once the value of the card is determined, the card count module 306 may determine the card count such as running count 210 and/or true count 212 (shown in FIG. 2). Information shown in table 202 along with the view 200 (shown in FIG. 2) may be displayed on the display device 312.

It should be appreciated that the components in FIG. 3 may be arranged in a wide variety of manners. For example, the components may be arranged such that they may be separate components, all included as a single component, or any combination thereof, and accordingly, the claimed subject matter is not limited in these respects. Additionally, it should be appreciated that communicatively coupled include a wide variety of communicative coupling such as, but not limited to, wired and wireless technologies, and accordingly, the claimed subject matter is not limited in these respects.

It is contemplated within the present disclosure that the card valuation module 304 may be configured to employ methodologies related to determining various information from seemingly random type systems (e.g., shuffling of playing cards) such as, but not limited to, chaos theory related methodologies, Markov chain Monte Carlo methodologies, Monte Carlo methodologies, etc. to determine advantages in a card game via a video capture device.

Figure 4:
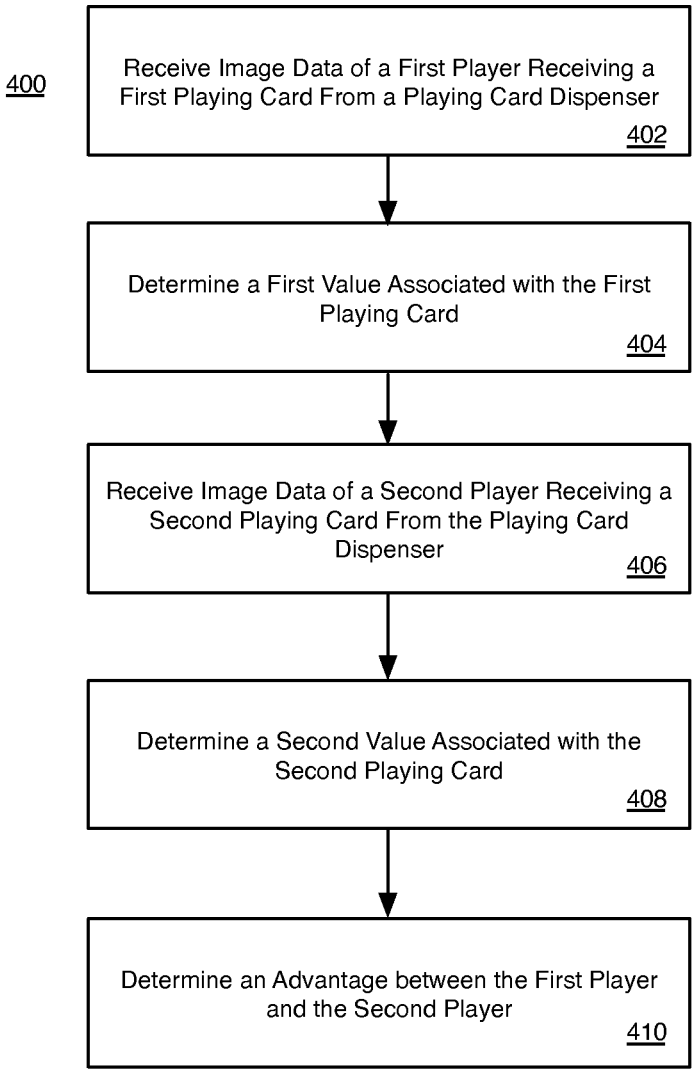
FIG. 4 illustrates an operational flow for determining advantages in a card game via a video capture device.

FIG. 4 illustrates an operational flow for determining advantages in a card game via a video capture device, arranged in accordance with at least some embodiments described herein. In some portions of the description, illustrative implementations of the method are described with reference to elements of the system 100 depicted in FIG. 1. However, the described embodiments are not limited to these depictions. More specifically, some elements depicted in FIG. 1 may be omitted from some implementations of the methods detailed herein. Furthermore, other elements not depicted in FIG. 1 may be used to implement example methods detailed herein.

Additionally, FIG. 4 employs block diagrams to illustrate the example methods detailed therein. These block diagrams may set out various functional blocks or actions that may be described as processing steps, functional operations, events and/or acts, etc., and may be performed by hardware, software, and/or firmware. Numerous alternatives to the functional blocks detailed may be practiced in various implementations. For example, intervening actions not shown in the figures and/or additional actions not shown in the figures may be employed and/or some of the actions shown in the figures may be eliminated. In some examples, the actions shown in one figure may be operated using techniques discussed with respect to another figure. Additionally, in some examples, the actions shown in these figures may be operated using parallel processing techniques. The above described, and other not described, rearrangements, substitutions, changes, modifications, etc., may be made without departing from the scope of claimed subject matter.

In some examples, operational flow 400 may be employed as part of a real-time video of a card game. Beginning at block 402 ("Receive Image Data of a First Player Receiving a First Playing Card From a Playing Card Dispenser"), the card valuation module 304 may receive image data from the video capture device 102 of the player 104 receiving the playing card 110 from the shoe 112.

Continuing from block 402 to 404 ("Determine a First Value Associated with the First Playing Card"), the card valuation module 304 may determine the first value associated with the playing card 110, where the first value may be based at least in part on markings 118 on the playing card 110.

Continuing from block 404 to 406 ("Receive Image Data of a Second Player Receiving a Second Playing Card From the Card Dispenser"), the card valuation module 304 may receive image data from the video capture device 102 of the dealer 108 receiving the playing card 111 from the shoe 112.

Continuing from block 406 to 408 ("Determine a Second Value Associated with the Second Playing Card"), the card valuation module 304 may determine the second value associated with the playing card 111, where the second value may be based at least in part on markings 117 on the playing card 111. Information regarding the markings may be received optically and/or electronically (e.g., intelligent shoe).

Continuing from block 408 to 410 ("Determine an Advantage between the First Player and the Second Player"), the card valuation module 304 may determine the advantage between the player 104 and the dealer 108 based at least in part on the first value and the second value.

In some embodiments, the card valuation module 304 may determine information displayed on table 202. Accordingly, the card valuation module 304 may determine a running count 210 based at least in part on the first value and the second value. In some embodiments, the card valuation module 304 may determine a true count 212 based at least in part on the running count and a number of playing cards remaining in the shoe 112.

In general, the operational flow described with respect to FIG. 4 and elsewhere herein may be implemented as a computer program product, executable on any suitable computing system, or the like. For example, a computer program product for determining advantages in a card game via a video capture device may be provided. Example computer program products are described with respect to FIG. 5 and elsewhere herein.

Figure 5:
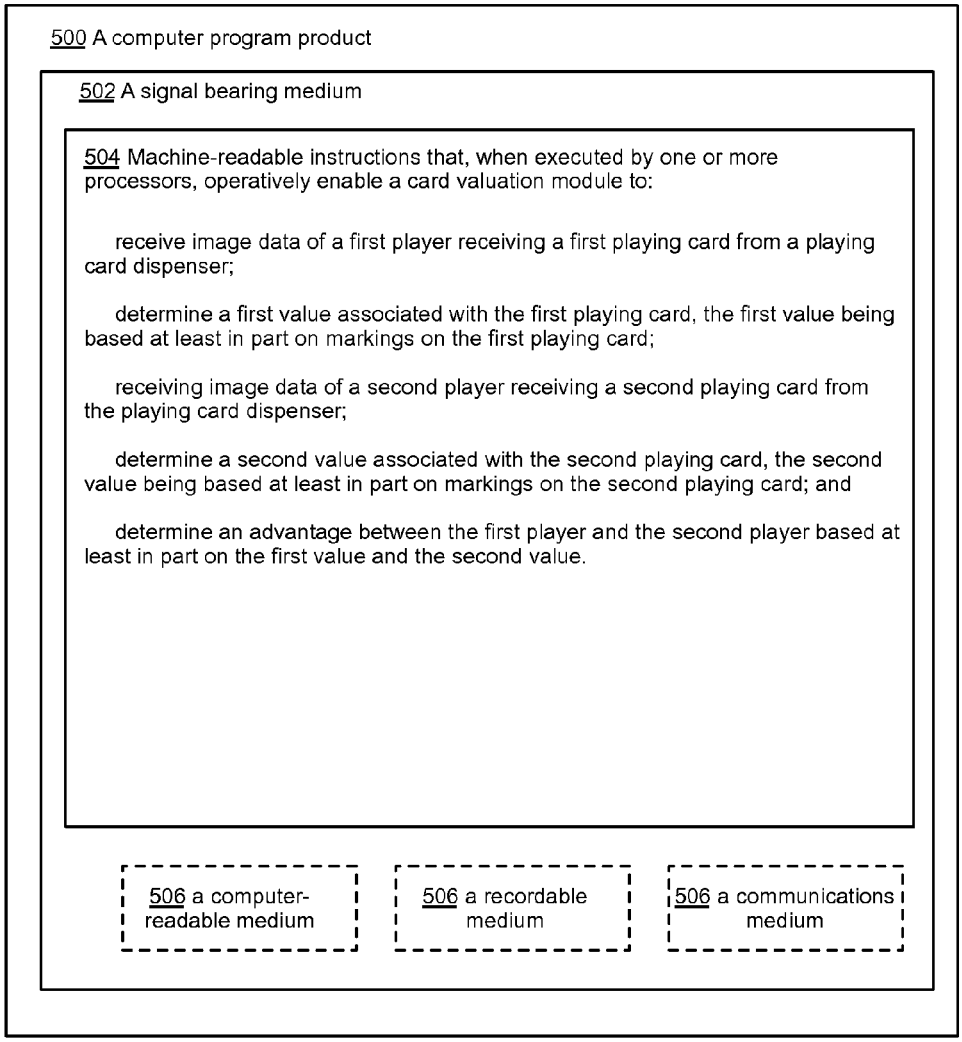
FIG. 5 illustrates an example computer program product, arranged in accordance with at least some embodiments described herein.

FIG. 5 illustrates an example computer program product 500, arranged in accordance with at least some embodiments described herein. Computer program product 500 may include machine readable non-transitory medium having stored therein instructions that, when executed, cause the machine to determine advantages in a card game via a video capture device according to the processes and methods discussed herein. Computer program product 500 may include a signal bearing medium 502. Signal bearing medium 502 may include one or more machine-readable instructions 504, which, when executed by one or more processors, may operatively enable a computing device to provide the functionality described herein. In various examples, some or all of the machine-readable instructions may be used by the devices discussed herein.

In some examples, the machine readable instructions 504 may include receiving image data of a first player receiving a first playing card from a playing card dispenser. In some examples, the machine readable instructions 504 may include determining a first value associated with the first playing card, the first value being based at least in part on markings on the first playing card. In some examples, the machine readable instructions 504 may include receiving image data of second player receiving a second playing card from the playing card dispenser. In some examples, the machine readable instructions 504 may include determining a second value associated with the second playing card, the second value being based at least in part on markings on the second playing card. In some examples, the machine readable instructions 504 may include determining an advantage between the first player and the second player based at least in part on the first value and the second value.

In some implementations, signal bearing medium 502 may encompass a computer-readable medium 506, such as, but not limited to, a hard disk drive, a Compact Disc (CD), a Digital Versatile Disk (DVD), a digital tape, memory, etc. In some implementations, the signal bearing medium 502 may encompass a recordable medium 508, such as, but not limited to, memory, read/write (R/W) CDs, R/W DVDs, etc. In some implementations, the signal bearing medium 502 may encompass a communications medium 510, such as, but not limited to, a digital and/or an analog communication medium (e.g., a fiber optic cable, a waveguide, a wired communication link, a wireless communication link, etc.). In some examples, the signal bearing medium 502 may encompass a machine readable non-transitory medium.

In general, the methods described with respect to FIG. 4 and elsewhere herein may be implemented in any suitable computing system. Example systems may be described with respect to FIG. 6 and elsewhere herein. In general, the system may be configured to determine real-time advantages in a card game via an image capture device.

Figure 6:
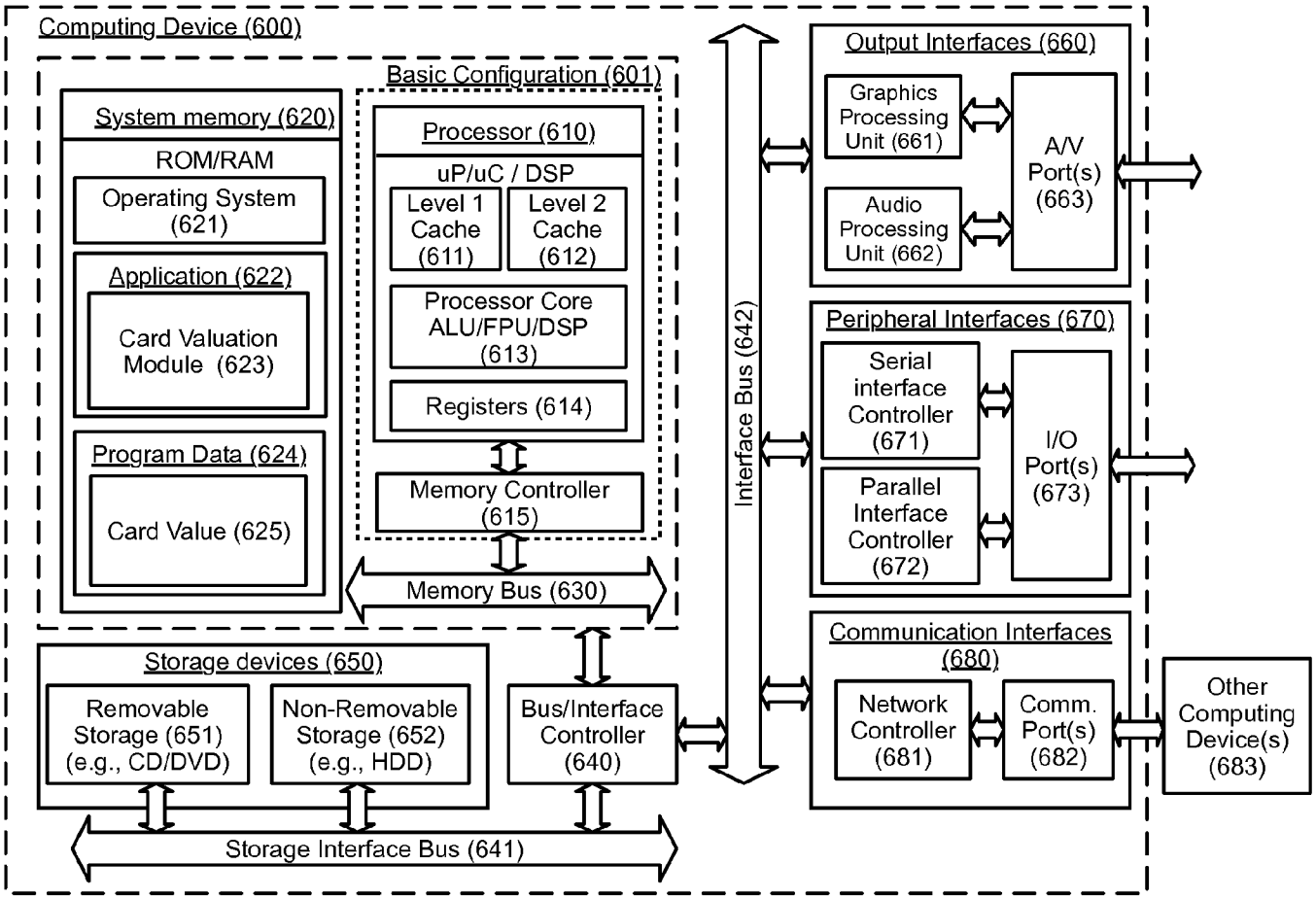
FIG. 6 is an illustration of a block diagram of an example computing device, all arranged in accordance with at least some embodiments described herein.

FIG. 6 is a block diagram illustrating an example computing device 600, arranged in accordance with at least some embodiments described herein. In various examples, computing device 600 may be configured to determine real-time advantages in a card game via an image capture device as discussed herein. In one example of a basic configuration 601, computing device 600 may include one or more processors 610 and a system memory 620. A memory bus 630 can be used for communicating between the one or more processors 610 and the system memory 620.

Depending on the desired configuration, the one or more processors 610 may be of any type including but not limited to a microprocessor (μP), a microcontroller (μC), a digital signal processor (DSP), or any combination thereof. The one or more processors 610 may include one or more levels of caching, such as a level one cache 611 and a level two cache 612, a processor core 613, and registers 614. The processor core 613 can include an arithmetic logic unit (ALU), a floating point unit (FPU), a digital signal processing core (DSP Core), or any combination thereof. A memory controller 615 can also be used with the one or more processors 610, or in some implementations the memory controller 615 can be an internal part of the processor 610.

Depending on the desired configuration, the system memory 620 may be of any type including but not limited to volatile memory (such as RAM), non-volatile memory (such as ROM, flash memory, etc.) or any combination thereof. The system memory 620 may include an operating system 621, one or more applications 622, and program data 624. The one or more applications 622 may include card valuation module application 623 that can be arranged to perform the functions, actions, and/or operations as described herein including the functional blocks, actions, and/or operations described herein. The program data 624 may include card value data 625 for use with the card valuation module application 623. In some example embodiments, the one or more applications 622 may be arranged to operate with the program data 624 on the operating system 621. This described basic configuration 601 is illustrated in FIG. 6 by those components within dashed line.

Computing device 600 may have additional features or functionality, and additional interfaces to facilitate communications between the basic configuration 601 and any required devices and interfaces. For example, a bus/interface controller 640 may be used to facilitate communications between the basic configuration 601 and one or more data storage devices 650 via a storage interface bus 641. The one or more data storage devices 650 may be removable storage devices 651, non-removable storage devices 652, or a combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), and tape drives to name a few. Example computer storage media may include volatile and nonvolatile, removable and non-removable media implemented in any method or technology for storage of information, such as computer readable instructions, data structures, program modules, or other data.

The system memory 620, the removable storage 651 and the non-removable storage 652 are all examples of computer storage media. The computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which may be used to store the desired information and which may be accessed by the computing device 600. Any such computer storage media may be part of the computing device 600.

The computing device 600 may also include an interface bus 642 for facilitating communication from various interface devices (e.g., output interfaces, peripheral interfaces, and communication interfaces) to the basic configuration 601 via the bus/interface controller 640. Example output interfaces 660 may include a graphics processing unit 661 and an audio processing unit 662, which may be configured to communicate to various external devices such as a display or speakers via one or more A/V ports 663. Example peripheral interfaces 670 may include a serial interface controller 671 or a parallel interface controller 672, which may be configured to communicate with external devices such as input devices (e.g., keyboard, mouse, pen, voice input device, touch input device, etc.) or other peripheral devices (e.g., printer, scanner, etc.) via one or more I/O ports 673. An example communication interface 680 includes a network controller 681, which may be arranged to facilitate communications with one or more other computing devices 683 over a network communication via one or more communication ports 682. A communication connection is one example of a communication media. The communication media may typically be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RF), infrared (IR) and other wireless media. The term computer readable media as used herein may include both storage media and communication media.

The computing device 600 may be implemented as a portion of a small-form factor portable (or mobile) electronic device such as a cell phone, a mobile phone, a tablet device, a laptop computer, a personal data assistant (PDA), a personal media player device, a wireless web-watch device, a personal headset device, an application specific device, or a hybrid device that includes any of the above functions. The computing device 600 may also be implemented as a personal computer including both laptop computer and non-laptop computer configurations. In addition, the computing device 600 may be implemented as part of a wireless base station or other wireless system or device.

Some portions of the foregoing detailed description are presented in terms of algorithms or symbolic representations of operations on data bits or binary digital signals stored within a computing system memory, such as a computer memory. These algorithmic descriptions or representations are examples of techniques used by those of ordinary skill in the data processing arts to convey the substance of their work to others skilled in the art. An algorithm is here, and generally, is considered to be a self-consistent sequence of operations or similar processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals or the like. It should be understood, however, that all of these and similar terms are to be associated with appropriate physical quantities and are merely convenient labels. Unless specifically stated otherwise, as apparent from the following discussion, it is appreciated that throughout this specification discussions utilizing terms such as "processing," "computing," "calculating," "determining" or the like refer to actions or processes of a computing device, that manipulates or transforms data represented as physical electronic or magnetic quantities within memories, registers, or other information storage devices, transmission devices, or display devices of the computing device.

The claimed subject matter is not limited in scope to the particular implementations described herein. For example, some implementations may be in hardware, such as employed to operate on a device or combination of devices, for example, whereas other implementations may be in software and/or firmware. Likewise, although claimed subject matter is not limited in scope in this respect, some implementations may include one or more articles, such as a signal bearing medium, a storage medium and/or storage media. This storage media, such as CD-ROMs, computer disks, flash memory, or the like, for example, may have instructions stored thereon, that, when executed by a computing device, such as a computing system, computing platform, or other system, for example, may result in execution of a processor in accordance with the claimed subject matter, such as one of the implementations previously described, for example. As one possibility, a computing device may include one or more processing units or processors, one or more input/output devices, such as a display, a keyboard and/or a mouse, and one or more memories, such as static random access memory, dynamic random access memory, flash memory, and/or a hard drive.

There is little distinction left between hardware and software implementations of aspects of systems; the use of hardware or software is generally (but not always, in that in certain contexts the choice between hardware and software can become significant) a design choice representing cost vs. efficiency tradeoffs. There are various vehicles by which processes and/or systems and/or other technologies described herein can be affected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a flexible disk, a hard disk drive (HDD), a Compact Disc (CD), a Digital Versatile Disk (DVD), a digital tape, a computer memory, etc.; and a transmission type medium such as a digital and/or an analog communication medium (e.g., a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to subject matter containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

Reference in the specification to "an implementation," "one implementation," "some implementations," or "other implementations" may mean that a particular feature, structure, or characteristic described in connection with one or more implementations may be included in at least some implementations, but not necessarily in all implementations. The various appearances of "an implementation," "one implementation," or "some implementations" in the preceding description are not necessarily all referring to the same implementations.

While certain exemplary techniques have been described and shown herein using various methods and systems, it should be understood by those skilled in the art that various other modifications may be made, and equivalents may be substituted, without departing from claimed subject matter. Additionally, many modifications may be made to adapt a particular situation to the teachings of claimed subject matter without departing from the central concept described herein. Therefore, it is intended that claimed subject matter not be limited to the particular examples disclosed, but that such claimed subject matter also may include all implementations falling within the scope of the appended claims, and equivalents thereof.

What is claimed:

1. A method implemented in a computing device for determining advantages in a card game via a video capture device, the method comprising:

receiving, by the computing device via the video capture device, image data of a first player receiving a first playing card from a playing card dispenser;

determining, by the computing device, a first value associated with the first playing card, the first value being based at least in part on markings recognized by the computing device from the received image data of the first player receiving the first playing card from the playing card dispenser on the first playing card;

receiving, by the computing device via the video capture device, image data of a second player receiving a second playing card from the playing card dispenser;

determining, by the computing device, a second value associated with the second playing card, the second value being based at least in part on markings recognized by the computing device from the received image data of the second player receiving the second playing card from the playing card dispenser on the second playing card;

comparing, by the computing device, the first value associated with the first playing card received by the first player with the second value associated with the second playing card received by the second player;

determining, by the computing device, a probability of whether a next card from the playing card dispenser will have a high-value or a low-value based, at least in part, on the comparing; and determining, by the computing device, an advantage between the first player and the second player based, at least in part, on the determined probability;

causing to display on a display device the advantage between the first player and the second player;

determining that at least one of the first player or the second player is a betting player;

correlating a betting habit of the betting player with the determined advantage; and determining if the correlated betting habit of the betting player meets a particular threshold.

2. The method of claim 1, wherein determining the advantage comprises determining a running count based at least in part on the first value and the second value.

3. The method of claim 2, wherein determining the advantage comprises determining a true count based at least in part on the running count and a number of playing cards remaining in the playing card dispenser.

4. The method of claim 1, wherein determining the advantage comprises determining a value of playing cards remaining in the playing card dispenser, the determined value being based at least in part on the first value and the second value.

5. The method of claim 1, wherein determining the first value comprises receiving an indication of the markings on the first playing card from the playing card dispenser.

6. The method of claim 1, wherein determining the second value comprises receiving an indication of the markings on the second playing card from the playing card dispenser.

7. A machine readable non-transitory medium having stored therein instructions that, when executed by one or more processors, operatively enable a card valuation module, the card valuation module included in a computing device, to:

receive, via a video capture device, image data of a first player receiving a first playing card from a playing card dispenser;

determine a first value associated with the first playing card, the first value being based at least in part on markings recognized by the card valuation module from the received image data of the first player receiving the first playing card from the playing card dispenser on the first playing card;

receive, via the video capture device, image data of a second player receiving a second playing card from the playing card dispenser;

determine a second value associated with the second playing card, the second value being based at least in part on markings recognized by the computing device from the received image data of the second player receiving the second playing card from the playing card dispenser on the second playing card;

compare the first value associated with the first playing card received by the first player with the second value associated with the second playing card received by the second player;

determine a probability of whether a next card from the playing card dispenser will have a high-value or a low-value based, at least in part, on the compared first value associated with the first playing card received by the first player with the second value associated with the second playing card received by the second player; and determine an advantage between the first player and the second player based, at least in part, on the determined probability cause to display on a display device the advantage between the first player and the second player determine that at least one of the first player or the second player is a betting player;

correlate a betting habit of the betting player with the determined advantage; and determine if the correlated betting habit of the betting player meets a particular threshold.

8. The machine readable non-transitory medium of claim 7, wherein the stored instruction that, when executed by one or more processors, further operatively enable the card valuation module to determine a running count based at least in part on the first value and the second value.

9. The machine readable non-transitory medium of claim 8, wherein the stored instruction that, when executed by one or more processors, further operatively enable the card valuation module to determine a true count based at least in part on the running count and a number of playing cards remaining in the playing card dispenser.

10. The machine readable non-transitory medium of claim 7, wherein the stored instruction that, when executed by one or more processors, further operatively enable the card valuation module to determine a value of playing cards remaining in the playing card dispenser, the determined value being based at least in part on the first value and the second value.

11. The machine readable non-transitory medium of claim 7, wherein the stored instruction that, when executed by one or more processors, further operatively enable the card valuation module to receive an indication of the markings on the first playing card from the playing card dispenser.

12. The machine readable non-transitory medium of claim 7, wherein the stored instruction that, when executed by one or more processors, further operatively enable the card valuation module to receive an indication of the markings on the second playing card from the playing card dispenser.

13. A system for determining advantages in a card game comprising:

a video capture device;

a computing device communicatively coupled to the video capture device;

a display device communicatively coupled to the computing device; and a card valuation module included in the computing device, the card valuation module configured to:

receive, via the video capture device, image data of a first player receiving a first playing card from a playing card dispenser;

determine a first value associated with the first playing card, the first value being based at least in part on markings recognized by the card valuation module from the received image data of the first player receiving the first playing card from the playing card dispenser on the first playing card;

receive, via the video capture device, image data of second player receiving a second playing card from the playing card dispenser;

determine a second value associated with the second playing card, the second value being based at least in part on markings recognized by the computing device from the received image data of the second player receiving the second playing card from the playing card dispenser on the second playing card;

compare the first value associated with the first playing card received by the first player with the second value associated with the second playing card received by the second player;

determine a probability of whether a next card from the playing card dispenser will have a high-value or a low-value based, at least in part, on the compared first value associated with the first playing card received by the first player with the second value associated with the second playing card received by the second player; and cause to display on the device the advantage between the first player and the second player;

determine an advantage between the first player and the second player based, at least in part, on the determined probability;

determine that at least one of the first player or the second player is a betting player;

correlate a betting habit of the betting player with the determined advantage; and determine if the correlated betting habit of the betting player meets a particular threshold.

14. The system of claim 13, wherein the card valuation module is further configured to determine a running count based at least in part on the first value and the second value.

15. The system of claim 14, wherein the card valuation module is further configured to determine a true count based at least in part on the running count and a number of playing cards remaining in the playing card dispenser.

16. The system of claim 13, wherein the card valuation module is further configured to determine a value of playing cards remaining in the playing card dispenser, the determined value being based at least in part on the first value and the second value.

17. The system of claim 13, wherein the card valuation module is further configured to receive an indication of the markings on the first playing card from the playing card dispenser.

18. The system of claim 13, wherein the card valuation module is further configured to receive an indication of the markings on the second playing card from the playing card dispenser.

* * * * *